US006325010B1

(12) United States Patent
Gruenwald

(10) Patent No.: US 6,325,010 B1
(45) Date of Patent: Dec. 4, 2001

(54) METHOD OF VESSEL PROPULSION WITH COORDINATED BOW PROPULSION

(75) Inventor: David Gruenwald, Delray Beach, FL (US)

(73) Assignee: Power Vent Technologies, Inc., Pompano Beach, FL (US)

( * ) Notice: Subject to any disclaimer, the term of this patent is extended or adjusted under 35 U.S.C. 154(b) by 0 days.

(21) Appl. No.: 09/538,565

(22) Filed: Mar. 29, 2000

(51) Int. Cl.[7] ..... B63H 25/46
(52) U.S. Cl. ..... 114/151; 114/144 B
(58) Field of Search ..... 440/68, 69; 114/151, 114/144 B, 144 R

(56) References Cited

U.S. PATENT DOCUMENTS

| | | | | |
|---|---|---|---|---|
| 804,497 | * | 11/1905 | Palmer | 440/69 |
| 3,078,661 | * | 2/1963 | Spence | 114/151 |
| 3,844,242 | * | 10/1974 | Sernatinger et al. | 114/144 B |
| 4,315,476 | | 2/1982 | van der Tak . | |
| 4,377,981 | | 3/1983 | Clausen . | |
| 4,419,082 | | 12/1983 | Krautkremer et al. . | |
| 4,580,517 | | 4/1986 | Lundberg . | |
| 4,747,359 | * | 5/1988 | Ueno | 114/144 B |
| 4,941,423 | * | 7/1990 | Van Tassel | 114/289 |
| 5,090,929 | | 2/1992 | Rieben . | |
| 5,129,846 | | 7/1992 | Dimijian . | |
| 5,282,763 | | 2/1994 | Dixon . | |
| 5,501,072 | | 3/1996 | Plancich et al. . | |
| 5,522,336 | | 6/1996 | Veronesi et al. . | |
| 5,642,684 | | 7/1997 | Aker . | |
| 5,758,592 | * | 6/1998 | Benson, Jr. | 114/330 |
| 5,896,016 | | 4/1999 | Bayer . | |

* cited by examiner

*Primary Examiner*—Ed Swinehart
(74) *Attorney, Agent, or Firm*—McHale & Slavin

(57) ABSTRACT

The instant invention is an improved method for handling and steering vessels and the apparatus for carrying out the method. The invention relates to vessels having fixed shaft propulsion systems and particularly to those vessels in which the propeller is positioned within a tunnel beneath the vessel. The improvements in the steering and handling of such a vessel are realized by inclusion of a bow propulsion system which is integral with and whose operation is coordination with that of the main propulsion system.

12 Claims, 5 Drawing Sheets

METHOD OF VESSEL PROPULSION WITH COORDINATED BOW PROPULSION

FIELD OF THE INVENTION

This invention relates to the close quarter maneuvering of vessels and particularly to improvements in the steering and handling of such a vessel by inclusion of a coordinated bow propulsion system.

BACKGROUND OF THE INVENTION

Vessels are typically designed to be maneuverable when making sufficient headway such that movement of their rudders or steerable propulsion systems allows for directional change of the vessel. When operating in reverse, the maneuverability of such vessels is significantly hampered. In close quarter maneuvering, such as for docking purposes, the skill of the operator often makes the difference between safe docking or a dangerous situation since typical propulsion systems fail to address this situation. Docking is particularly difficult if there is any wind or current present. For this reason, most boaters view the docking of a vessel the most unpleasurable of boating experiences. Such experiences further inhibit inexperienced boaters from enjoying the water in all but the most calm conditions.

Bow and stern thrusters have been made available, but require a level of skill to operate in that an operator must control the thruster in addition to the main propulsion systems. This coordination has made the present use of thrusters limited to only the most un-maneuverable vessels and experienced captains.

Today, the most efficient high speed marine propulsion systems use surfacing propellers. The typical surfacing propeller system is transom mounted and allows adequate forward handling but only marginal handling in reverse. The typically surfacing propellers change the direction of the thrust by turning the entire drive assembly on the stern of the boat to push the stern port or starboard. These surfacing drive systems are both complicated and expensive in that they require large mechanical systems to be mounted aft of the transom of the boat.

U.S. Pat. No. 4,689,026 (the contents of which are herein incorporated by reference), teaches a marine surface drive system which incorporates surface piercing propeller technology beneath the hull of a vessel. As with any fixed propeller system, such propulsion systems lack adequate directional control when reverse thrust is employed. The propeller tunnel vertical walls further complicate the problem since their surfaces make pushing the transom of the boat to port or starboard more difficult due to the additional effort required to move a vertical surfaces sideways in the water.

U.S. Pat. No. 5,016,553 to Spencer discloses a vector control steering system which utilizes a transom mounted thrusting device which is integrated with a stern mounted main drive system. Such a system would not cure the deficiencies of a tunnel mounted surface piercing propulsion system such as Small's because of the increased effort required to move the vessel's stern laterally.

Most marine vessels require a lateral stabilizing force at their aft end to minimize the tendency at high speed for a "spin out". In a "spin out" the vessel spins uncontrollably regardless of corrective action taken by the operator. To control this tendency some form of lateral resistance is employed.

The easiest way to understand this is to look at a weather vane. Weather vanes have a large area behind the axis of rotation to keep the pointed end always pointing into the wind. Boats are no different. They need a large area behind their axis of rotation (the center of gravity) to keep their nose pointed in the right direction and avoid "spin out". The most common method of providing this source of lateral resistance is a rudder. While rudders provide steerage they also provide stability and resistance to lateral motion.

Spencer overlooks this conflict of design; instead of providing the thrust application at the front of the boat where lateral resistance to motion is the least, he proposes thrusting laterally at the rear of the vessel where the inherent resistance to lateral motion is the greatest and the application of a thruster the least effective. While it would be possible to steer the boat with his approach the cost of such a system would be far greater than if the thrust were applied to the bow. History bears this out as there are no commercially available transom thrusters in use today.

Numerous prior art patents have utilized auxiliary thrusters, for example: U.S. Pat. No. 5,522,335 discloses a combined azimuthing and tunnel auxiliary thruster for a vessel. U.S. Pat. No. 5,642,684 is directed toward a thrust directing unit for a marine vessel comprising a diverging wall outlet with adjustable deflector vanes contained therein and an adjustable water jet flow. U.S. Pat. No. 5,501,072 discloses a combined centrifugal and paddle-wheel side thruster for boats. U.S. Pat. No. 5,282,763 teaches a steerable bow thruster useful for swath vessels. These thrusters utilize a motive force device to provide a supply of pressurized water which is directed through rotatable outlets. U.S. Pat. No. 5,146,865 discloses a water jet propulsion system for shallow draft vessels. U.S. Pat. No. 5,129,846 teaches a vessel propulsion system including longitudinally spaced forward and rear zones including forwardly and rearwardly directed jet openings in combination with a pump and controllable valving system for providing propulsion and steerage. U.S. Pat. No. 5,090,929 provides paired spaced electrically driven motors at the transom for steering and propelling small boats.

U.S. Pat. No. 4,580,517 is directed toward a vessel having parallel hulls and thrustable which are rotatable through 360 degrees of rotation. U.S. Pat. No. 4,419,082 describes a driving and controlling device including a water-jet drive mechanism for shallow draft vessels. U.S. Pat. No. 4,377,981 teaches a lateral thrust rudder for ships including a cross channel which traverses the ship from one side to the other and a propeller mounted within the cross channel. U.S. Pat. No. 4,315,476 teaches a steering system for ships incorporating a propeller in a flow duct having deflectors for directing flow to one side of the vessel or the other. U.S. Pat. No. 5,896,016 is drawn to a process for optimizing the real power levels by regulating the rotational speed of both bow and stern mounted propellers, e.g. in a vessel such as a ferry having independent bow and stern drive systems.

What is lacking in the art is a coordinated bow propulsion system for enhanced maneuverability of vessels moving at low speeds or when using reverse thrust. In a particularly desirable embodiment, the enhanced propulsion system would be incorporated in such a manner that it became invisible to the driver by actuating the bow thruster in coordination with the vessel's steering wheel and shift lever.

SUMMARY OF THE INVENTION

The instant invention describes a vessel, an improved method for handling and steering of a vessel, for example those having a planing hull, or a semi-displacement hull, having a submerged or surfacing propeller drive system, an improved propulsion method for a vessel including the apparatus for carrying out the method, and a unique coordinated bow propulsion system.

Although the overall concept of inclusion of a coordinated bow propulsion system is contemplated for use in any known combination of vessel and propulsion system, the instant disclosure will illustrate the novel bow propulsion system in combination with a surface drive propulsion system. Typical surfacing drive systems contemplated for use with the instant invention are marine propulsion systems in which a prime mover, such as an inboard engine or equivalent, is mechanically interfaced, for example via a shaft and strut system or a gearcase, with at least one non-pivoting/non-steering surfacing type propeller. The propulsion system may be disposed in a tunnel that runs longitudinally in the bottom of a marine watercraft. The propeller may be located within the tunnel or within a semi-enclosed area, and, as previously stated is of the surfacing type and does not pivot for the purpose of steering the vessel. A flat rudder or several rudders may be positioned behind the propeller, alternatively, a semicircular rudder may be positioned above the propeller, as is commonly found in conventional inboards, jet drives or some fixed shaft surface drives. In addition there may be an additional rudder positioned in front of the propeller which is connected thru linkages to the rudder behind the propeller.

The instant invention teaches a novel method for enhanced vessel propulsion which includes the steps of:

1) providing a vessel having a bow and a stern, wherein said vessel includes a primary means for propulsion emanating from the stern thereof;
2) incorporating a secondary means for propulsion forwardly positioned upon said vessel and adapted to selectively emit one or more propulsive forces bilaterally with respect to said vessel;
3) providing a means for coordinated control of said primary and secondary means for propulsion in response to a request for a directional response; and
4) requesting a directional response from said vessel by utilizing a means for steering said vessel, a means for directional engagement of said primary propulsion system or a combination thereof.

The above-outlined steps result in the requesting step instigating multi-directional and simultaneous emission of propulsive forces from the primary and secondary means for propulsion in an amount and a direction effective to yield the requested directional response. The instant invention similarly teaches a vessel propulsion system and a unique vessel incorporating this technology.

Improved steering and handling, especially in low speed, reverse thrust and docking situations, is realized by inclusion of a specially designed bow-thruster mechanism, the operation of which is essentially invisible and seamless to the boat's operator. The operation of the bow thruster is integrally combined with the normal steering mechanism of the boat and is automatically called into operation when specific gear shift lever placement or rudder positioning parameters are met. Operation of the integral bow-thruster in coordination with both the steering and transmission mechanism of the main surfacing drive system is accomplished via the use of electrical, hydraulic and/or mechanical controls.

The process and apparatus of the instant invention provides precise maneuvering capability to vessel's having fixed shaft propulsion systems during all low speed, reverse thrust and zero thrust situations, thereby affording the operator an ease of use not heretofore attainable with such drive systems. Fixed shaft marine propulsion drive systems, as defined herein, include both propeller drive systems and water jet propulsion systems.

Accordingly, it is an objective of the instant invention to teach a vessel having a fixed shaft drive system that provides enhanced maneuverability.

It is a further objective of the instant invention to teach a surface drive system including an integral bow-thrusting propulsion device for coordinated operation with the main propulsion system.

It is yet another objective of the instant invention to teach a control mechanism and process for its use which provides automatic operation of the integral bow-thrusting propulsion system.

It is still an additional objective of the instant invention to teach a means for coordinated control of a vessel propulsion system which includes electrically or mechanically actuated coupling devices constructed and arranged to vary the direction and magnitude of propulsion emitted by said secondary propulsion means in response to the magnitude and direction of steering adjustment, primary propulsion directional adjustment or a combination thereof.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
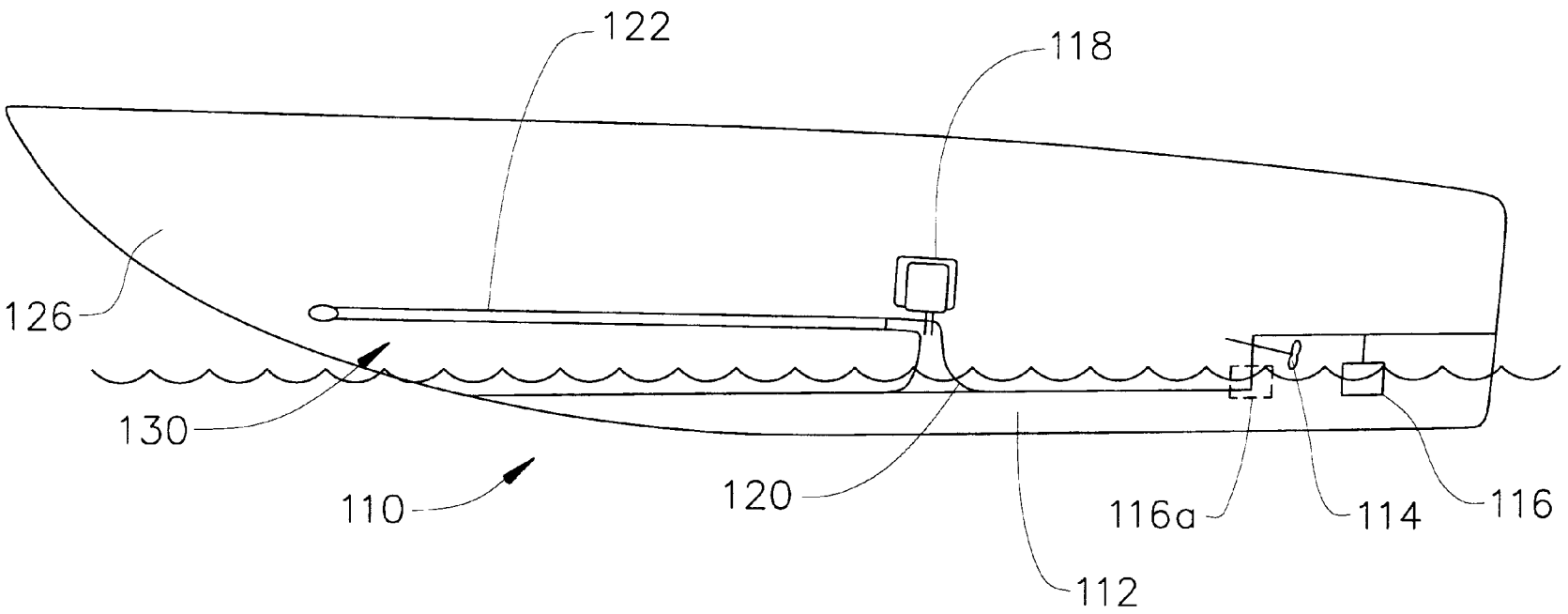
FIG. 1 is a cross-sectional view of a vessel having a tunnel-mounted fixed shaft drive system and a coordinated bow thrusting propulsion mechanism.

In accordance with FIG. 1, vessel 110, which may be of a planing or semi-displacement hull design, includes a semi-enclosed area or tunnel 112 within which a non-pivoting surface drive propeller 114 is positioned. In accordance with the instant invention, the tunnel may be open or closed downwardly. At least a single rudder or other means 116 is positioned behind the propeller for providing steering and maneuverability while under way.

In an alternative embodiment, a secondary rudder 116A may be positioned in front of the propeller which is capable of providing enhanced maneuvering capabilities, especially when reverse thrust is being applied. A bow thrusting mechanism, 130 is incorporated within the vessel's propulsion system and its operation is coordinated and integral with the operator's use of the vessel's steering wheel and gearshift lever (which are not shown).

Figure 2:
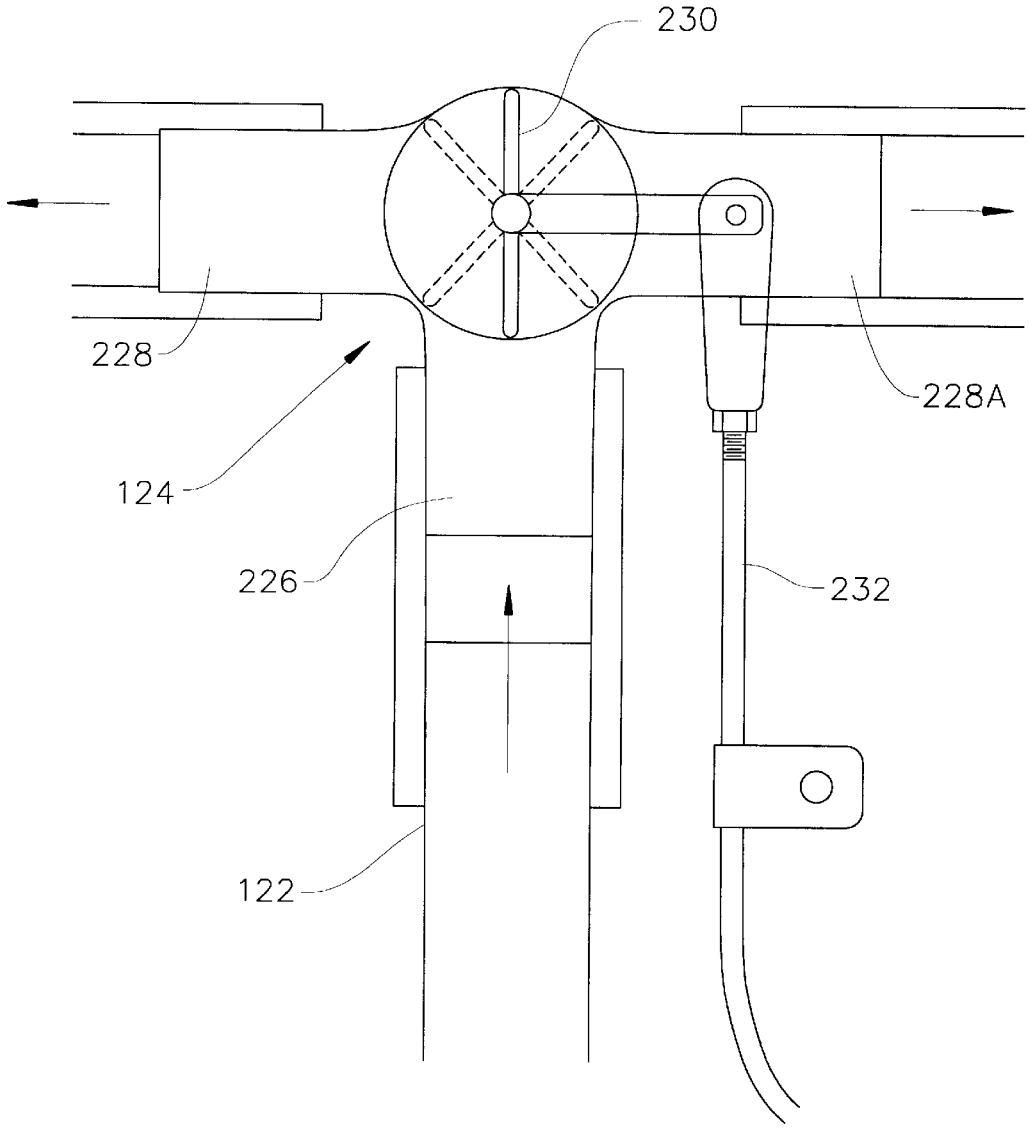
FIG. 2 is a cross-sectional view of the bow-thrusting nozzle and diverter mechanism.

In a particular embodiment the bow thruster includes a motorized pump 118 which may be mounted at any location within the vessel, so long as it is in fluid communication with a thru-hull fitting 120. The motorized pump 118 is in fluid communication with a conduit 122, which may, for example, be an aluminum pipe or the like. The conduit 122 functions to direct pressurized water drawn in by pump 118 via the thru-hull fitting toward outlet nozzle assembly 124. Nozzle assembly 124 (as best seen in FIG. 2) contains a diverter mechanism to control port or starboard emission of the pressurized stream thereby providing the desired sideways propulsion control to the vessel's bow 126. While it is contemplated that the nozzle and associated outlet can be incorporated in any vessel, in a particularly preferred embodiment, the hull may be molded to have bilateral egress passages integral therewith.

As more specifically detailed in FIG. 2, the nozzle assembly 124 is in the form of a T-fitting having an inlet 226 for receipt of pressurized water from pump 118, and outlets 228 and 228A for selectively directing the output of pressurized water to either side of the vessel. A diverter valve 230, which is mounted at the junction of the T-shaped nozzle 124, is mechanically and/or electrically coupled to the steering mechanism (not shown) via a primary control cable 232 for providing integral and coordinated directional control of the vessel's bow in concert with the directional control being provided by the rudder and/or the vessel's main propulsion system.

Figure 3:
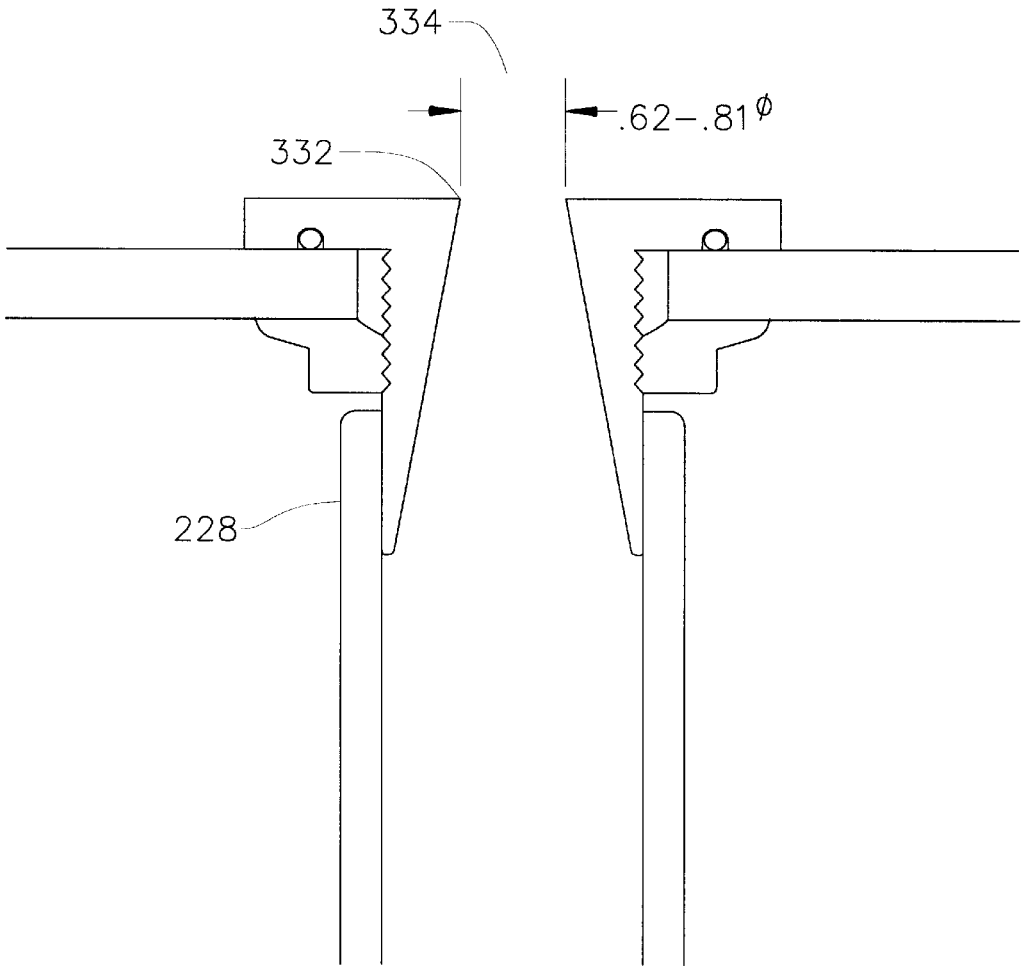
FIG. 3 is a cross-sectional view of the converging thru-hull nozzle of the bow-thruster.

As particularly illustrated in FIG. 3, the port or starboard outlet of the nozzle assembly 124 ends in a converging nozzle 332 which creates a high velocity output stream 334. The supply conduit 122 may typically be about 2" in diameter and the converging nozzle(s) may narrow to a proportion thereof, for example to a diameter in the range of 0.38 to 1.25 inches.

The interconnection of the vessel's transmission and steering systems with the bow thrusting propulsion system may be effected via mechanical coupling, e.g. cables and/or hydraulic actuating means. Alternatively, electrical controls may be incorporated to provide an even greater degree of precision during operation of the integral bow thruster system.

Figure 4:
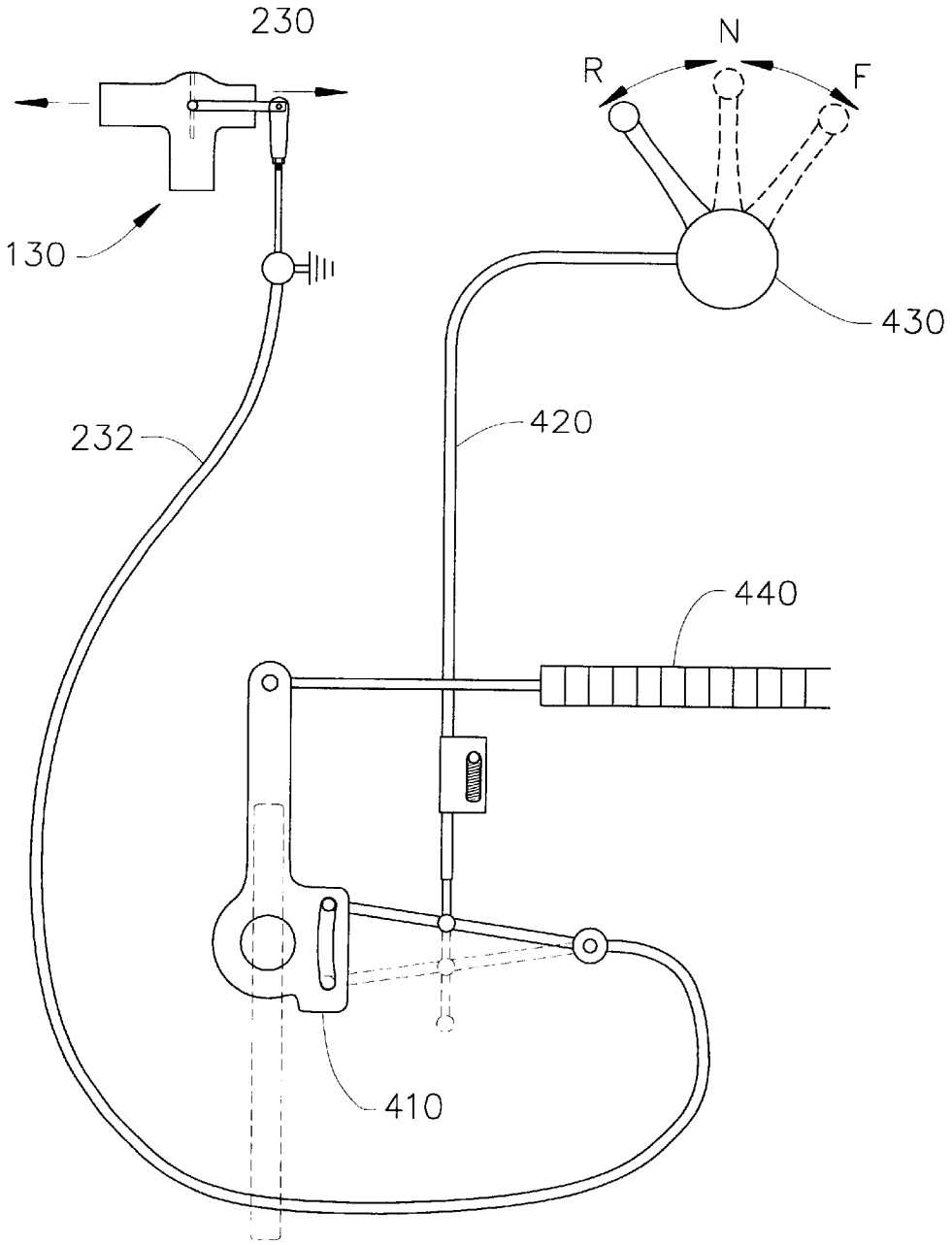
FIG. 4 is a diagram illustrating a mechanically controlled coupling system for coordinated operation of the bow-thruster and main propulsion and steering system.

In accordance with FIG. 4, a mechanically coupled operating system is illustrated. This system is merely exemplary of the type of mechanical control system useful in the integration and coordination of the surface drive and bow thrusting propulsion systems. Alternative systems which function in an equivalent manner are likewise deemed to be within the purview of the instant invention. Now with reference to the figure, a bow thruster(s) 130 is shown. The bow thruster may be of the type illustrated in FIG. 2 supra or it may be of an alternative design, e.g. two separate thrusters mounted on opposite sides of the vessel. For ease of illustration, a thruster equivalent to that of FIG. 2 is shown. A primary control cable 232 is mechanically coupled between the diverter valve 230 and the rudder 116. The mechanical coupling to the rudder 116 is in the form of a slidable engagement means 410 which is adjustable from a first position forward of the rudder's axis of rotation to a second position aft of the rudder's axis of rotation. The forward/aft positioning is determined by an auxiliary control cable 420 which mechanically links the primary control cable 232 and shift control lever 430. When in the forward or neutral position, the primary cable connection is positioned aft of the rudder's axis of rotation. Thus, if the vessel's main surface drive propulsion system is engaged to push the vessel forward (or is in the neutral position), when the steering wheel (not shown) is rotated to the right, the steering arm 440 causes the rudder 116 to rotate counterclockwise and causes the primary cable 232 to push the diverter valve 230 thereby causing it to emit thrust from the port side, and thus directing the bow to the right. Alternatively, when the main drive system is in reverse, the primary cable connection is slidably engaged forward of the axis of the rudder's rotation, thus if now rotated counterclockwise the auxiliary control cable 420 will pull the diverter 230 causing thrust to be emitted from the starboard side, and thereby causing the bow to move to port.

Figure 5:
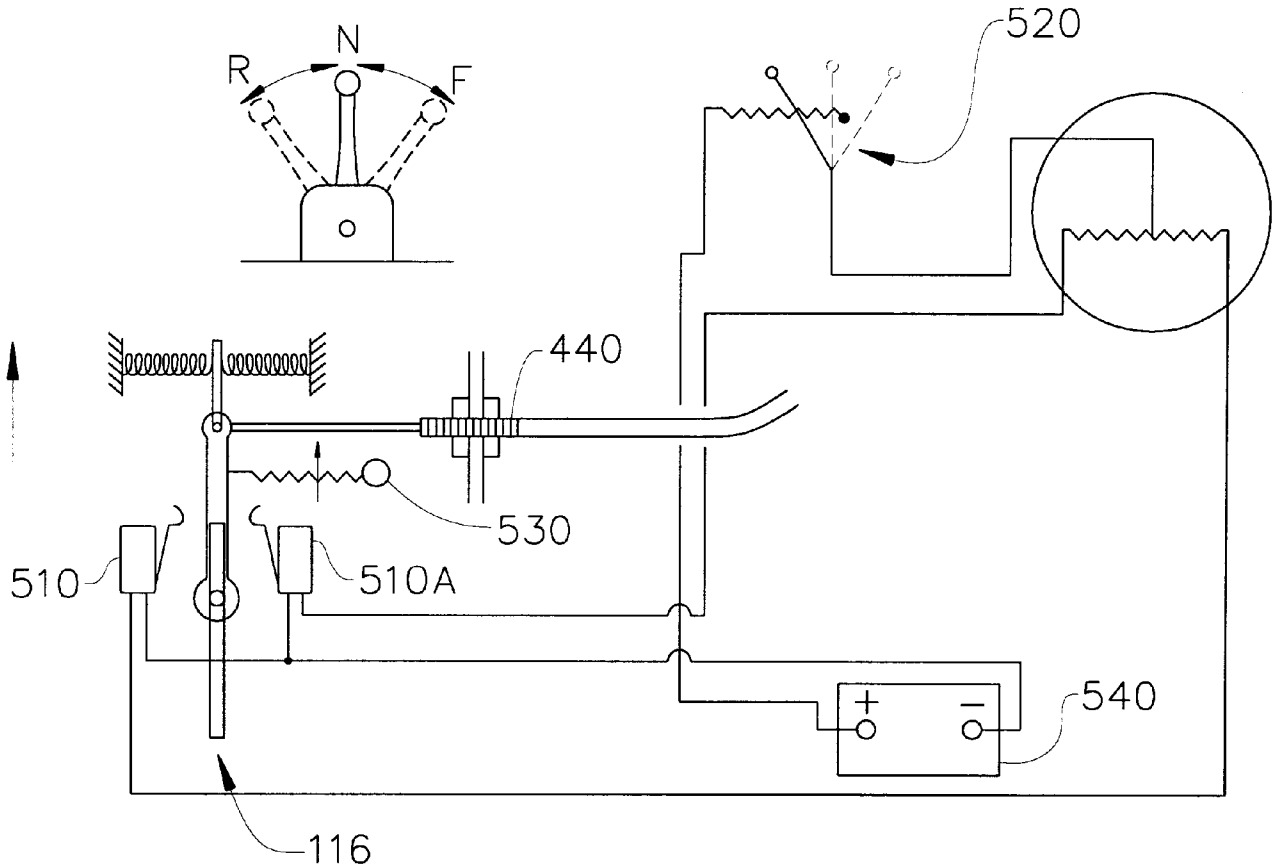
FIG. 5 is a diagram/schematic illustrating a mechanical/electrical control and coupling system for coordinated operation of the bow-thruster and main propulsion and steering system.

In accordance with FIG. 5, an electromechanical system is further illustrated. A circuit diagram including a voltage source 540 is illustrated wherein, depending upon the direction of rotation of the rudder 116, a micro-switch 510,510A is closed which determines the polarity of the circuit and thereby the direction in which current will be allowed to flow through the bow thruster (not shown). A secondary switch 520 provides for completion of the circuit only when the neutral or forward gear box positions are chosen. Thus, the thruster will be engaged and will emit thrust in a particular direction depending upon rudder position and gear shift lever positioning in accordance with Table 1.

TABLE 1

| SHIFT POSITION | STEERING PORT | STEERING NEUTRAL | STEERING STARBOARD |
|---|---|---|---|
| REVERSE | ON | ON | ON |
| NEUTRAL | ON | ON | ON |
| FORWARD | OFF | OFF | OFF |

A potentiometer 530 provides an enhanced degree of control by varying the thruster speed as a function of rudder deflection. Lastly, in order to provide further enhanced operation, the steering wheel (not shown) is spring loaded to return to the neutral rudder position, thus causing the vessel to always return to a straight ahead course.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A method for enhanced vessel maneuvering vessel having a hull with a bow and port and starboard sides connected to a stern, and a motor connected to at least one propeller as a primary means for propulsion emanating from said stern thereof, said vessel including a steering mechanism connected to a rudder at said stern, said motor and said rudder providing directional control to port, starboard, forward and reverse, said method comprising:

incorporating bow thrusters on said port and starboard sides of said vessel, said bow thrusters including a source of pressurized water and conduits through which said pressurized water is transmitted to a port nozzle and a starboard nozzle forwardly positioned upon said vessel and adapted to selectively emit said pressurized water approximately bilaterally with respect to said vessel;

providing a coupling between said rudder and said bow thrusters for coordinated control of said rudder and said bow thrusters in response to a change in direction made by said steering mechanism;

requesting an adjustment of direction of said vessel by utilizing said steering mechanism;

said steering mechanism rotating said rudder about its axis of rotation; and said rotation instigating multi-directional and simultaneous emission of said pressurized water from said bow thrusters in an amount and a direction effective to yield the requested directional response.

2. The method for enhanced vessel propulsion in accordance with claim 1 wherein:

said vessel has a semi-displacement or a planing hull.

3. The method for enhanced vessel propulsion in accordance with claim 1 wherein:

said primary means for propulsion is a fixed shaft marine propulsion system.

4. The method for enhanced vessel propulsion in accordance with claim 1 wherein:

said coupling includes electrical or mechanical actuation of said coupling constructed and arranged to vary the direction and magnitude of said pressurized water emitted by said bow thrusters in response to the magnitude and direction of steering adjustment.

5. A method for enhanced vessel maneuvering in accordance with claim 1 including the steps of:

providing a gearshift for controlling said at least one propeller for moving said vessel in forward and reverse direction;

providing a coupling between said gearshift and said bow thrusters for coordinated control of said forward and reverse direction and said bow thrusters, said coupling controlling the emission of said bow thrusters;

moving said gearshift to select forward direction;

said coupling controlling one bow thruster;

moving said gearshift to select reverse direction; and said coupling controlling the other bow thruster.

6. A coordinated bow thruster system for enhanced maneuverability of a vessel having a bow, with port and starboard sides connected to a stern, said vessel having a motor connected to at least one propeller for primary movement in forward or reverse direction, said movement in reverse or forward controlled by a gearshift, said vessel having a steering mechanism connected to a rudder for directional control, said rudder connected to said vessel at said stern comprising:

bow thrusters located on said port and starboard sides of said bow of said vessel for emitting a propulsive force effective to rotate said bow; and control means operatively coupled between said means for primary movement, said steering mechanism and said bow thrusters;

said control means including one coupling device between said rudder and said bow thrusters and a second coupling device between said gearshift and said bow thrusters, said one coupling device selecting a particular bow thruster during forward movement of said vessel, said second coupling device selecting the opposite bow thruster during reverse movement of said vessel;

said control means effective for emitting said propulsive force in a particular amount and in a particular direction effective for maneuvering said vessel upon turning of said steering mechanism, movement of said gearshift, or a combination thereof.

7. A coordinated bow propulsion system of claim 6 wherein:

said vessel has a semi-displacement or a planing hull.

8. A coordinated bow thruster system of claim 6 wherein:

said said propeller is a surface piercing propeller drive system.

9. The vessel in accordance with claim 8 wherein:

said surface piercing propeller drive system is positioned within a tunnel.

10. A coordinated bow propulsion system of claim 6 wherein:

said control means includes electrically or mechanically actuated coupling devices constructed and arranged to vary the direction and magnitude of propulsion emitted by said bow thrusters in response to the magnitude and direction of steering adjustment, primary movement directional adjustment or a combination thereof.

11. A coordinated bow thruster system of claim 10 wherein:

said control means comprises a cable mechanically connected to said rudder and said bow thrusters, said rudder having an axis of rotation, said cable selecting a particular bow thruster upon rotation of said rudder.

12. A coordinated bow thruster system of claim 11 wherein:

said control means comprises a potentiometer on said rudder electrically connected to said bow thrusters, said potentiometer sending a signal to select a particular bow thruster upon rotation of said rudder.

* * * * *